US011177562B2

(12) United States Patent
Yang et al.

(10) Patent No.: US 11,177,562 B2
(45) Date of Patent: Nov. 16, 2021

(54) ELECTRONIC DEVICE

(71) Applicant: ASUSTeK COMPUTER INC., Taipei (TW)

(72) Inventors: Bo-Hua Yang, Taipei (TW); Yu-Hsiang Huang, Taipei (TW); Shao-Kai Liu, Taipei (TW); Zhi-Hua Feng, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 29 days.

(21) Appl. No.: 16/736,891

(22) Filed: Jan. 8, 2020

(65) Prior Publication Data

US 2020/0235465 A1 Jul. 23, 2020

(30) Foreign Application Priority Data

Jan. 23, 2019 (TW) ..... 108201106

(51) Int. Cl.
*H01Q 3/24* (2006.01)
*H01Q 1/42* (2006.01)
*H01Q 1/48* (2006.01)

(52) U.S. Cl.
CPC ..... *H01Q 1/421* (2013.01); *H01Q 1/48* (2013.01)

(58) Field of Classification Search
CPC H01Q 1/421; H01Q 1/48; H01Q 9/42; H01Q 1/243
USPC ..... 343/846
See application file for complete search history.

(56) References Cited

U.S. PATENT DOCUMENTS

| | | | | |
|---|---|---|---|---|
| 9,669,772 | B2 * | 6/2017 | Kono | B60R 11/04 |
| 10,658,753 | B2 * | 5/2020 | Tseng | H01Q 1/245 |
| 2015/0116176 | A1 * | 4/2015 | Gong | H01Q 1/243 343/821 |
| 2016/0307953 | A1 * | 10/2016 | Kono | H04N 5/22521 |
| 2019/0036223 | A1 * | 1/2019 | Wu | G06F 1/1656 |
| 2019/0044232 | A1 * | 2/2019 | Tseng | H01Q 5/378 |
| 2019/0363425 | A1 * | 11/2019 | Huang | H01Q 1/2266 |

FOREIGN PATENT DOCUMENTS

| | | |
|---|---|---|
| CN | 204167479 U | 2/2015 |
| CN | 103034291 B | 4/2017 |

* cited by examiner

*Primary Examiner* — Jean B Jeanglaude
(74) *Attorney, Agent, or Firm* — McClure, Qualey & Rodack, LLP

(57) ABSTRACT

An electronic device is provided. The electronic device includes a metal housing, an insulation element, and an antenna unit. The insulation element is disposed on the metal housing and includes a first heat dissipation hole. The antenna unit is disposed on the insulation element and includes a radiation portion and a feeding portion. The radiation portion is composed of a conductor. The feeding portion is electrically connected to the radiation portion and a grounding plane. In this way, according to the electronic device, space configuration inside the electronic device is saved and a shielding effect of the metal housing is prevented from affecting stability of sending and receiving a signal.

7 Claims, 5 Drawing Sheets

ELECTRONIC DEVICE

CROSS-REFERENCE TO RELATED APPLICATION

This application claims the priority benefit of Taiwan application serial No. 108201106, filed on Jan. 23, 2019. The entirety of the above-mentioned patent application is hereby incorporated by reference herein and made a part of the specification.

BACKGROUND OF THE INVENTION

Field of the Invention

The disclosure relates to an electronic device provided with an antenna unit. Description of the Related Art Nowadays, communications technologies develop rapidly. Communications technologies have become an indispensable part of modern life. However, with the improvement of life quality, people have higher requirements on a transmission rate and reception quality of electronic devices in sending and receiving a signal.

In recent years, various types of electronic devices are mostly designed to be light, thin, short and small. To improve the quality of products, metal is mostly used as the product appearance. However, a metal housing has a shielding effect, affecting transmission efficiency of an antenna inside an electronic device. Consequently, it is difficult to design an antenna in the industry.

BRIEF SUMMARY OF THE INVENTION

An objective of the disclosure is to provide an electronic device, to save space configuration inside the electronic device and prevent a shielding effect of a metal housing from affecting stability of sending and receiving a signal.

According to the first aspect of the disclosure, an electronic device is provided. The electronic device includes a metal housing, an insulation element, and an antenna unit. The insulation element is disposed on the metal housing and including a first heat dissipation hole. The antenna unit is disposed on the insulation element and including a radiation portion and a feeding portion. The radiation portion is composed of a conductor. The feeding portion is electrically connected to the radiation portion and a grounding plane.

In an embodiment, the insulation element is disposed in a slot on the metal housing.

In an embodiment, the insulation element further includes a second heat dissipation hole. The radiation portion is extended and disposed between the first heat dissipation hole and the second heat dissipation hole.

In an embodiment, the antenna unit further includes a grounding portion. The grounding portion is electrically connected to the radiation portion and the grounding plane.

In an embodiment, the antenna unit includes at least one of an inverted F antenna, a monopole antenna, or a coupled antenna.

In an embodiment, the radiation portion is formed on the insulation element by a laser circuit technology.

In an embodiment, a gap exists between the radiation portion and the first heat dissipation hole, and a width of the gap ranges between 0.2 millimeters and 0.4 millimeters.

In an embodiment, a location of the first heat dissipation hole corresponds to the slot.

Compared with the prior art, according to the electronic device of the disclosure, the antenna unit is disposed on the metal housing by using the insulation element, and therefore, space configuration inside the electronic device is saved. In addition, because the antenna unit is disposed on an outer side of the electronic device, the shielding effect of the metal housing is prevented from affecting stability of sending and receiving a signal.

DETAILED DESCRIPTION OF THE EMBODIMENTS

Figure 1A:
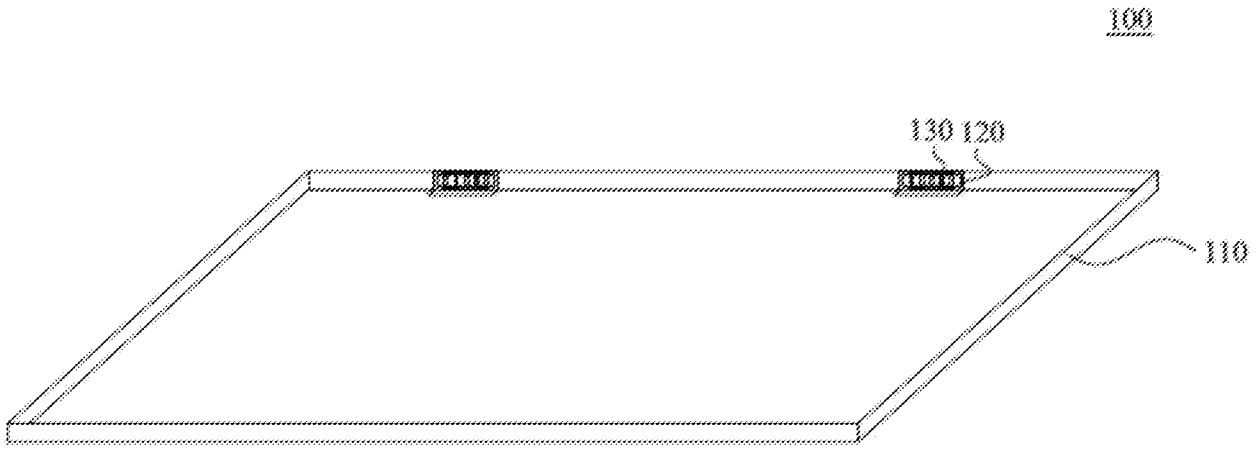
FIG. 1A is a schematic diagram of an electronic device according to some embodiments of the disclosure.

Various embodiments of the disclosure will be disclosed in the accompanying drawings, and for purposes of clarity of illustration, numerous practical details will be set forth in the following description. It should be understood, however, that these practical details are not intended to limit the disclosure. That is, in some embodiments of the disclosure, such practical details are unnecessary. In addition, some well-known and customary structures and elements will be shown in the drawings in a simple schematic manner for the sake of simplifying the drawings.

As used herein, an element, when referred to as "connected" or "coupled", may refer to "electrically connected" or "electrically coupled". "Connected" or "coupled" may also be used to mean that two or more elements cooperate or interact with each other. Furthermore, although terms such as "first" and "second" are used to describe different elements herein, the terms are only intended to distinguish elements or operations described with same technical terms. Unless the context clearly indicates otherwise, the terms neither indicate or imply a sequence or an order, nor limit the disclosure.

The disclosure relates to an electronic device 100. The electronic device 100 sends and receives a signal via an antenna module. When a housing of the electronic device is made of metal, a slot is usually provided on the housing to ensure a good transmission efficiency of an antenna. Through mutual coupling between the slot and the antenna, a radiation capability of the antenna is achieved. However, the manner is limited by an appearance design of the electronic device. If the electronic device is designed with a "narrow bezel", the radiation capability of the antenna is not achieved. It is to disclose that when the electronic device 100 is provided with a metal housing, the antenna inside the electronic device 100 still keeps a good transmission efficiency without affecting the configuration of the electronic device.

Figure 1B:
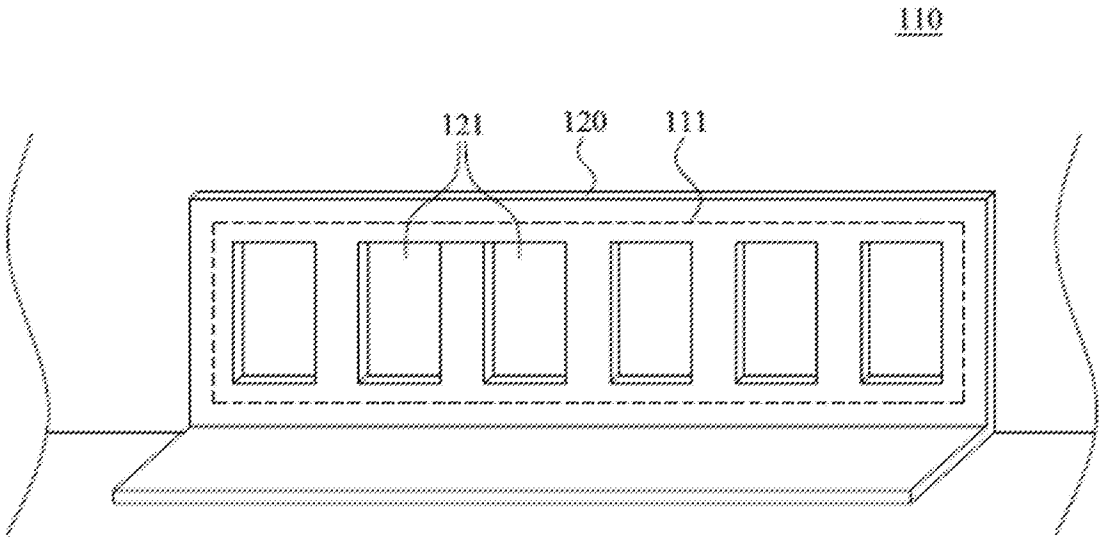
FIG. 1B is a schematic diagram of a metal housing and an insulation element according to some embodiments of the disclosure.

Referring to FIG. 1A and FIG. 1B, the disclosure relates to an electronic device 100. The electronic device 100 includes a metal housing 110, an insulation element 120, and an antenna unit 130. The metal housing 110 in FIG. 1A is a base housing of the electronic device 100. For ease of description of technical features of the disclosure, the metal housing 110 is partially shown in FIG. 1B. In some embodiments, the electronic device 100 further includes electronic components such as a processor, a circuit board, and a power unit, a radiator and a heat dissipation fan. In an embodiment, the electronic device is a notebook computer, a smartphone, or the like. When the electronic device 100 is operated, the internal electronic components generate heat. The heat dissipation fan is configured to generate air flow to discharge heat from the electronic device 100.

FIG. 1B is a partial enlarged view of the metal housing 110. In some embodiments, the metal housing 110 includes at least one slot 111. The insulation element 120 is disposed at a location on the metal housing 110 and corresponding to the slot 111. The insulation element 120 includes at least one heat dissipation hole 121. The number of the heat dissipation holes 121 is not limited. In an embodiment, six heat dissipation holes 121 are configured and appointed. The heat dissipation holes 121 are arranged horizontally with a predetermined spacing between each other. However, the disclosure is not limited to the structure shown in FIG. 1B. A location of the heat dissipation hole 121 corresponds to the slot 111, to be in communication with each other. When the electronic device 100 operates, the air flow generated by the heat dissipation fan is dispensed from the electronic device 100 through the heat dissipation hole 121 and the slot 111.

Figure 2:
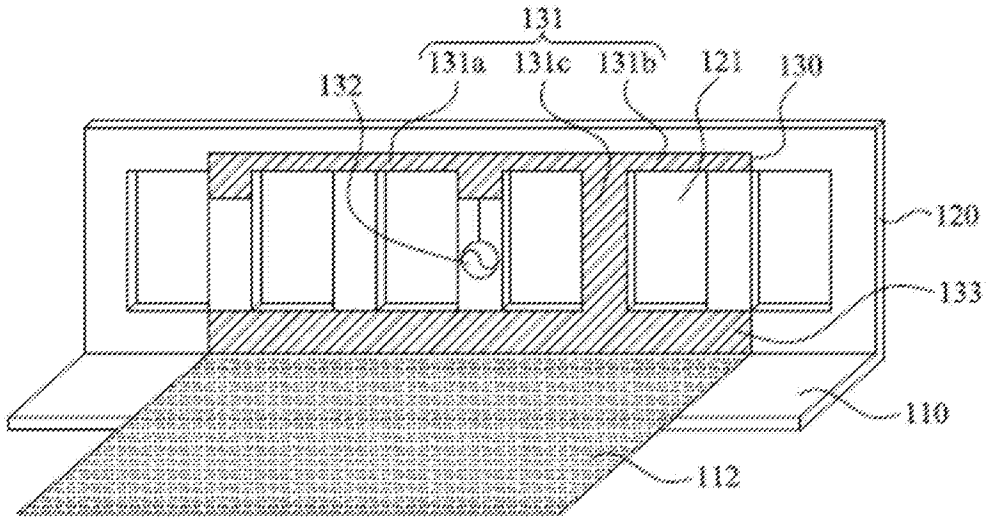
FIG. 2 is a schematic diagram of an antenna unit according to some embodiments of the disclosure.

Referring to FIG. 1A to FIG. 2, the antenna unit 130 with a radiation portion 131 and a feeding portion 132 is disposed on the insulation element 120. The radiation portion 131 is composed of a conductor such as a metal layer formed on an inner side surface or an outer side surface of the metal housing 110. The feeding portion 132 is electrically connected to the radiation portion 131 and a grounding plane 112. In an embodiment, the feeding portion 132 receives a communication signal sent by a communications unit inside the electronic device 100. In some embodiments, the grounding plane 112 is connected to the metal housing 110. In other embodiments, however, the grounding plane 112 is a part of the metal housing 110.

The antenna unit 130 is disposed on the insulation element 120. Therefore, no antenna space is required in the electronic device 100, so that the electronic device 100 is configured for lighter and thinner. In the disclosure, the slot 111 is disposed on the metal housing 110 for disposing the insulation element 120 and the heat dissipation hole 121. Therefore, while being disposed on the insulation element 120, the antenna unit 130 is not affected by the shielding effect of the metal housing 110, thereby having ideal transmission efficiency. In addition, because the antenna unit 130 is disposed around the heat dissipation hole 121, no extra space is required. That is, configuration of the antenna unit 130 does not affect space configuration inside the electronic device 100.

In some embodiments, the antenna unit 130 includes one of an inverted F antenna, a monopole antenna, or a coupled antenna. The antenna unit 130 and the insulation element 120 are integrated into an antenna module, to be applied to various devices provided with a metal housing.

Referring to FIG. 2, in some embodiments, the antenna unit 130 is an inverted F antenna, and including a first radiation portion 131*a* and a second radiation portion 131*b*. In FIG. 2, similar elements related to the embodiment in FIG. 1 are represented by using the same reference numerals for ease of understanding. A specific principle of the similar elements has been described in detail in the foregoing paragraphs. Unless there is a cooperative operation relationship between the elements in FIG. 2 and the similar elements, the similar elements are not described herein again. The first radiation portion 131*a* is configured to send or receive a low frequency signal (such as a 2.4 GHz signal). The second radiation portion 131*b* is configured to send or receive a high frequency signal (such as a5 GHz signal). In addition, in this embodiment, the antenna unit 130 further includes a third radiation portion 131*c* and a grounding portion 133. The third radiation portion 131*c* of the antenna unit 130 is extended and disposed between two heat dissipation holes 121 and is connected to the grounding portion 133. The grounding portion 133 is connected to the grounding plane 122 and the third radiation portion 131*c*.

In some embodiments, the antenna unit 130 is formed on the insulation element 120 by a laser circuit technology, so that the radiation portion 131 is located adjacent to the heat dissipation hole 121. However, a manner in which the antenna unit 130 is formed is not limited to the laser circuit technology. In other embodiments, the antenna unit 130 is alternatively formed on the insulation element 120 in a manner of electroplating, pasting, or the like. In some embodiments, the insulation element 120 is made of a plastic material, and is locked on the metal housing 110. However, in other embodiments, the insulation element 120 is fixed on the metal housing 110 in a manner of bonding, clamping, or the like.

Figure 3:
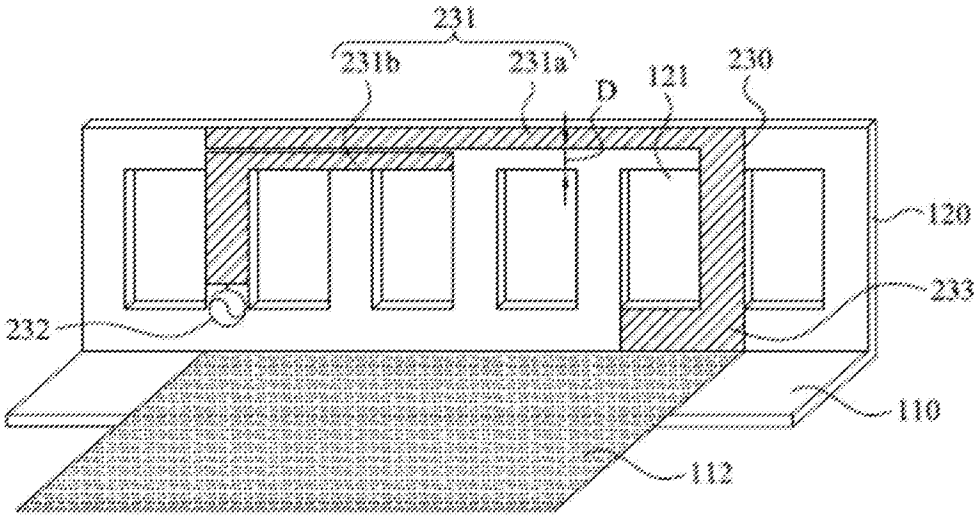
FIG. 3 is a schematic diagram of an antenna unit according to some embodiments of the disclosure.

Referring to FIG. 3, in some embodiments, an antenna unit 230 is a coupled antenna, and including a radiation portion 231, a feeding portion 232, and a grounding portion 233. In FIG. 3, similar elements related to the embodiment in FIG. 1 are represented by using the same reference numerals for ease of understanding. The specific principle of the similar elements has been described in detail in the foregoing paragraphs. Unless there is a cooperative operation relationship between the elements in FIG. 3 and the similar elements and therefore the similar elements are necessarily introduced, the similar elements are not described herein again. The radiation portion 231 further includes a first radiation portion 231*a* and a second radiation portion 231*b*. In some embodiments, a gap D is maintained between the antenna unit 230 and the heat dissipation hole 121. A width of the gap ranges between 0.2 millimeters and 0.4 millimeters. Similarly, like the embodiment shown in FIG. 2, there is also a gap between the antenna unit 130 and the heat dissipation hole 121. A size of the gap relates to a laser circuit technology.

Figure 4:
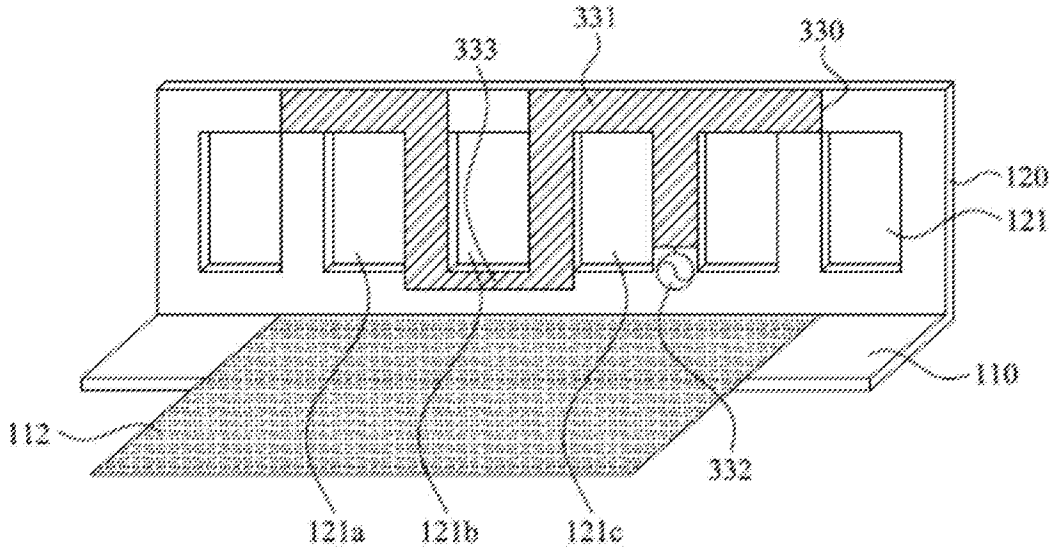
FIG. 4 is a schematic diagram of an antenna unit according to some embodiments of the disclosure.

Referring to FIG. 4, in some embodiments, an antenna unit 330 is a monopole antenna. In this embodiment, an insulation element 120 is provided with at least three heat dissipation holes 121 that are a first heat dissipation hole 121*a*, a second heat dissipation hole 121*b*, and a third heat dissipation hole 121*c* respectively. The antenna unit 330 includes a radiation portion 331, a feeding portion 332, and a grounding portion 333. The radiation portion 331 is disposed along a direction of the heat dissipation holes 121*a* to 121*c* and is extended between the first heat dissipation hole 121*a* and the second heat dissipation hole 121*b*, and between the second heat dissipation hole 121*b* and the third heat dissipation hole 121*c*, to be connected to the grounding portion 333.

The disclosure is disclosed through the foregoing embodiments; however, these embodiments are not intended to limit the disclosure. A person skilled in the art makes various variations and improvements without departing from the spirit and scope of the disclosure. Therefore, the protection scope of the disclosure should be subject to the appended claims.

What is claimed is:

1. An electronic device, comprising:

a metal housing;

an insulation element, disposed in a slot on the metal housing, and comprising a first heat dissipation hole; and an antenna unit, disposed on the insulation element, and comprising a radiation portion and a feeding portion, wherein the radiation portion is composed of a conductor, and the feeding portion is electrically connected to the radiation portion and a grounding plane.

2. The electronic device according to claim 1, wherein a location of the first heat dissipation hole corresponds to the slot.

3. The electronic device according to claim 1, wherein the insulation element further comprises a second heat dissipation hole, and the radiation portion is extended and disposed between the first heat dissipation hole and the second heat dissipation hole.

4. The electronic device according to claim 1, wherein the antenna unit further comprises a grounding portion, and the grounding portion is electrically connected to the radiation portion and the grounding plane.

5. The electronic device according to claim 1, wherein the antenna unit comprises at least one of an inverted F antenna, a monopole antenna, or a coupled antenna.

6. The electronic device according to claim 1, wherein the radiation portion is formed on the insulation element by a laser circuit technology.

7. The electronic device according to claim 1, wherein a gap exists between the radiation portion and the first heat dissipation hole, and a width of the gap ranges between 0.2 millimeters and 0.4 millimeters.

* * * * *